United States Patent [19]

Davis, Jr.

[11] 4,249,677

[45] * Feb. 10, 1981

[54] HAND HELD ELECTRIC CAULKING GUN

[76] Inventor: George B. Davis, Jr., 7512 Marbury Rd., Bethesda, Md. 20034

[ * ] Notice: The portion of the term of this patent subsequent to Oct. 16, 1996, has been disclaimed.

[21] Appl. No.: 26,654

[22] Filed: Apr. 3, 1979

Related U.S. Application Data

[63] Continuation-in-part of Ser. No. 876,048, Feb. 8, 1978, Pat. No. 4,171,072.

[51] Int. Cl.[3] ..... B67D 5/46

[52] U.S. Cl. ..... 222/326; 222/391

[58] Field of Search ..... 222/391, 325–327, 222/333; 74/122, 125, 125.5

[56] References Cited

U.S. PATENT DOCUMENTS

| | | | |
|---|---|---|---|
| 2,928,574 | 3/1960 | Wagner | 222/333 X |
| 3,401,847 | 9/1968 | Downing | 222/391 X |
| 3,913,799 | 10/1975 | Davis, Jr. | 222/326 |
| 4,171,072 | 10/1979 | Davis, Jr. | 222/326 |
| 4,180,187 | 12/1979 | Ben-Haim | 222/326 |

*Primary Examiner*—Charles A. Marmor

[57] ABSTRACT

A hand held electric caulking gun wherein a caulk-driving piston is forced through the caulk-retaining receptacle of the gun in a manner to force caulking from the gun with considerable force and at a continuous easy-to-control flow. The gun includes a clutch for drivably interrupting movement between the drive source and piston should the reacting force against the caulk driving end of the piston exceed a predetermined value and a piston release structure for allowing the piston to be disengaged of its drive linkage for allowing manual movement of the piston through the gun.

18 Claims, 8 Drawing Figures

Fig. 4
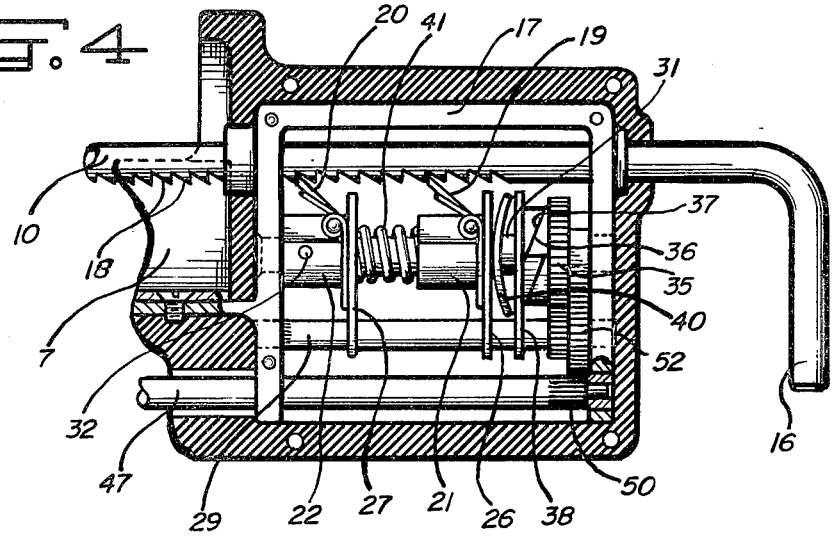
Fig. 5
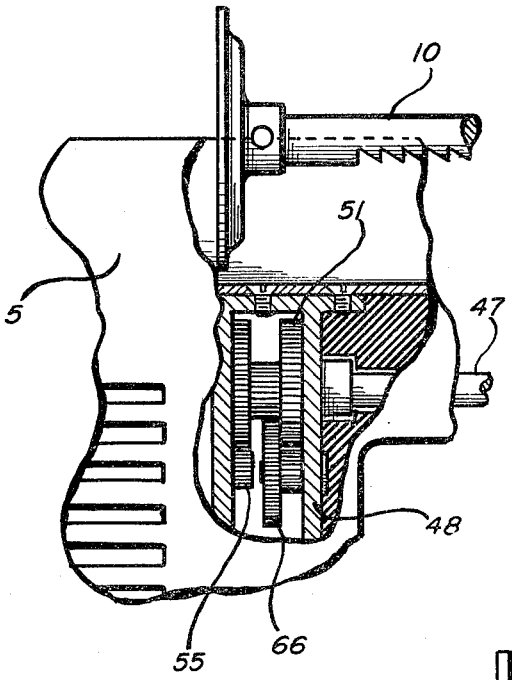
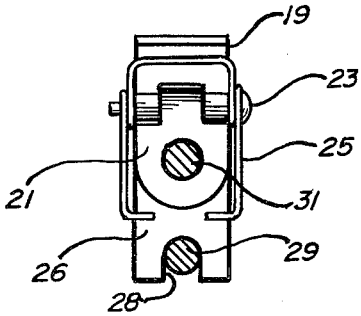
Fig. 6
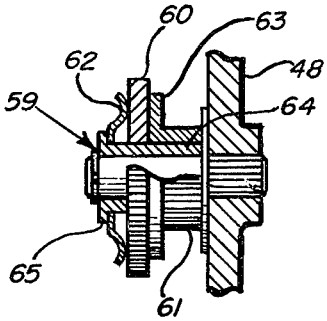
Fig. 7
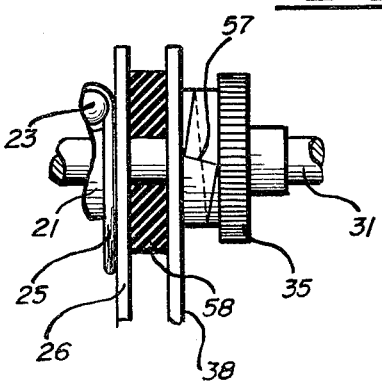
Fig. 8

HAND HELD ELECTRIC CAULKING GUN

This application is a continuation in part of application Ser. No. 876,048 filed 2/8/78 now matured into U.S. Pat. No. 4,171,072.

Caulking guns are well known in the art and are designed primarily for dispensing caulking that comes prepackaged within a cylindrival-like container or cartridge having projecting therefrom a dispensing nozzle through which the caulking is forced during the caulking operation. These guns include a receptacle wherein is received the cartridge with means being provided for driving a piston-like member through the cartridge thusly forcing the caulking from the nozzle.

Generally the piston of such apparatus is driven by variously constructed hand operated leverage mechanisms which serve to multiply the force applied, to more easily urge the piston through the cartridge. It is well known, however, that even with the mechanical advantage offered by such force multiplying mechanisms the effort required to drive the piston is considerable and frequently beyong the gripping capability of many. Yet in many instances the very livelihood of such individuals with trades such as painters, boatmen and general home repairmen depend upon operating such caulking guns.

It is the primary object of the present invention to provide an electric hand-held type caulking gun wherein the power required to drive the piston through the gun is applied by means of an electric motor which, by the closing of an electric switch, will enable even a child to dispense caulking of the most viscous composition and in a continuous, easy-to control flow, and in a manner unobtainable with conventional hand operated apparatus of this type.

It is a further object to provide a caulking gun of the type herein described wherein upon emptying of the caulking cartridge or upon any other form of interrupted forward movement of the driven piston, a clutching mechanism operates to interrupt movement between the driving mechanism and the piston thereby preventing damage to the housing or driving train mechanism of the device.

A still further object is to provide an electric caulking gun wherein the electric drive includes a variable speed control that will allow fast or slow dispensing of the caulking from the caulking cartridge as desired.

A further object is to provide an electric caulking gun including quick disengagement of the drive linkage from the piston after emptying of the cartridge thereby allowing the piston to be freed of the drive linkage to allow the piston to be manually movable through the gun.

Another object is to provide an electric caulking gun which, when in operation, dispenses the caulking from the gun with considerable force and in a manner to more positively penetrate such cracks and cravices into which the caulking is intended to flow and in a manner totally unobtainable by hand operated apparatus.

A further object is to provide an electric hand held motor driven caulking gun wherein, by the driving force of a reciprocating cam surface, as driven by the motor, a piston is caused to move through the gun with considerable force to drive caulking from the gun in a continuous easy to control flow and wherein between the piston and motor is interpositioned a resilient member operative to absorb totally or in part, the force of the cam stroke should movement of the piston be restrained beyond a predetermined value or should the piston be forcefully stopped against forward movement.

It is further desired to provide an electric hand-held caulking gun rugged in construction, reliable in operation and light in weight for either professional or domestic use yet relatively inexpensive to produce.

Other objects and advantages will become more apparent when referring to accompanying description and drawings wherein:

FIG. 4 is a fragmentary view partly in elevation and partly in section of the drive mechanism of the gun of FIG. 1.

FIG. 5 is a fragmentary section of the gun and showing as a cutaway a portion of the speed reducing linkage of the gun.

FIG. 6 is a forward view in elevation of the driving block and pawl and including the pawl actuating spring.

FIG. 7 is an alternate form of clutch mechanism that may be included in the high speed portion of the drive linkage FIG. 8 shows in section a rubber washer that may be substituted for the resilient element of the clutch assembly in the device of FIG. 4.

Figure 1:
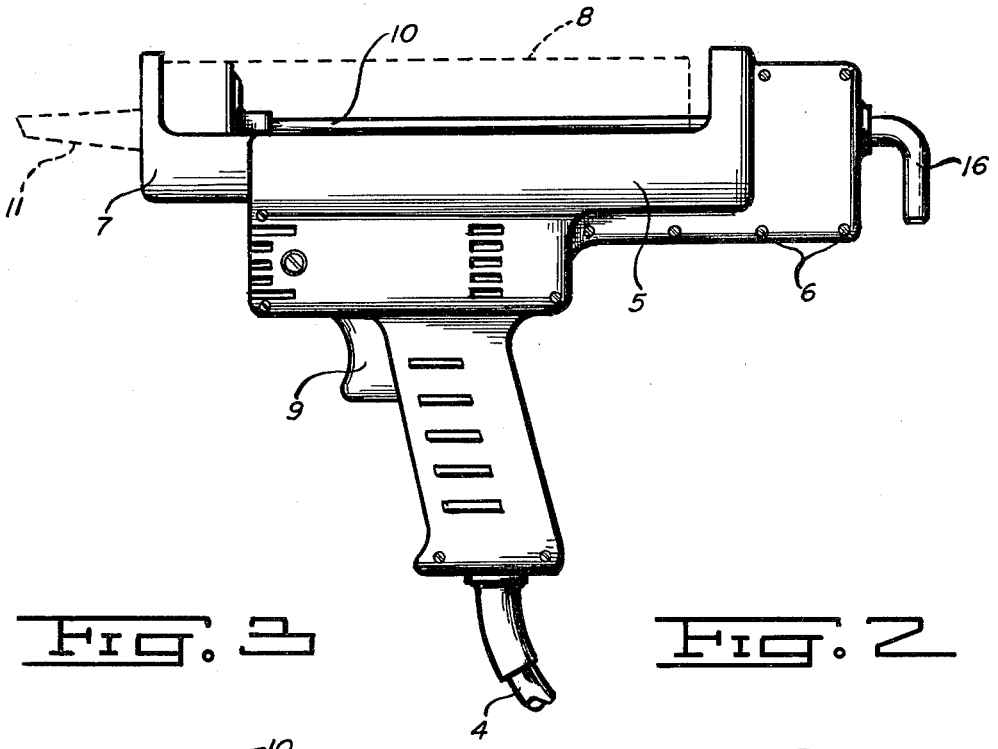
FIG. 1 is a side view in elevation of the caulking gun of the present invention.
Figure 3:
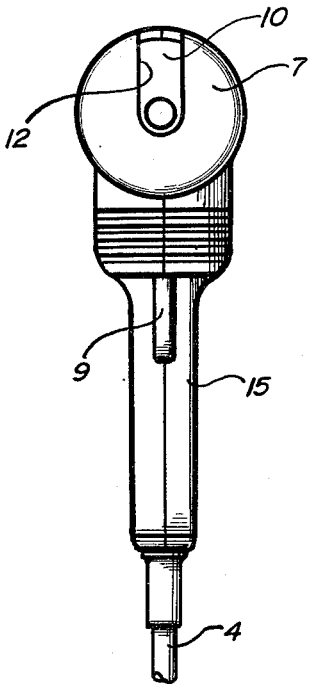
FIG. 3 is a front end view in elevation of the gun of FIG. 1.
Figure 2:
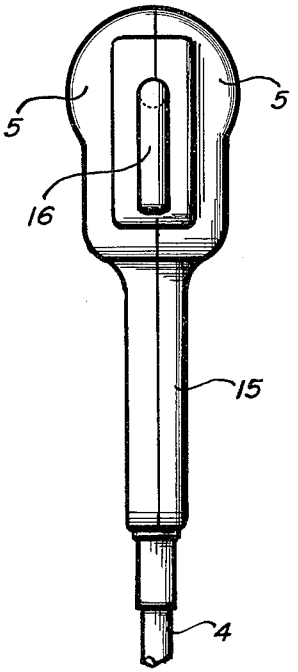
FIG. 2 is a rear view in elevation of the gun of FIG. 1.

Referring now to the drawings and particularly to FIG. 1 thereof wherein is shown a view of the gun in elevation and as including a plastic clam-shell type housing 5 secured about the mechanism of the gun as by screws 6. Fastened within the housing is a caulk receiving receptacle 7 preferably formed from aluminum for lightness and strength and wherein is received a caulk containing cartridge 8. When using the caulking gun, as herein shown, a cartridge is placed within the receptacle 7 whereupon, by operation of the motor within the gun by depressing trigger 9, a piston 10 is caused to be forcefully driventhrough the cartridge as required to force caulking from the cartridge by way of the nozzle 11. The nozzle extends from the gun through a notch 12 formed within the forward plate of the receptacle.

The handle portion of the gun 15 and including the trigger 9 and power supply cord 4, is shown as positioned well forward upon the gun case and thereby to more effectively balance the gun when supporting the weight of a caulking filled cartridge within the receptacle. The trigger 9 is preferably of the long stroke type and shall include a variable speed control for the motor. A long stroke trigger, including such a control, will provide for a more gradual control of the motor speed and thereby a more effectively control of caulking flow from the gun. From the rear of the gun extends the bent handle portion 16 of the piston and as shown in piston driving position. Rotation of the handle to a side or upward position serves to disengage the piston from the drive mechanism of the gun allowing manual movement of the piston in either direction through the gun. Clamped between the clam-shell plastic side sections 5 of the gun case as shown in FIG. 4 is a rear housing member 17 formed preferably as an aluminum die casting for lightness and through which extends the caulk driving piston 10 of the gun. The piston includes a series of teeth 18 formed along its lower surface and engaged by a driving pawl or dog 19 and a holding pawl or dog 20 hinge mounted respectively upon blocks 21 and 22 as by pins 23, FIG. 6. Springs 25 serve to respectively maintain these pawls in constant bearing contact with the surface of piston 10.

Depending from each of the blocks 21 and 22 and preferably formed as an integral portion thereof are flanges 26 and 27 respectively and wherein within each is formed a notch 28, FIG. 6. The legs of the notch extend downward and about the gear shaft 29 in a manner to secure the blocks against rotation and further to maintain pawls 19 and 20 properly oriented with respect to their working relation with the notched surface of the piston. While it is apparent that block 22 secured to the shaft 31 by pin 32 does not necessarily need the flange 27, it is desirable for cost that each block be identical in structure and preferably be constructed as powdered metal formings because of their odd configuration.

Mounted for rotation over shaft 31 is a gear 35 upon which is preferably integrally formed a driving cam surface 36 engaging in mating rotation a similarly formed driven cam surface 37 from which depends flange 38 that extends downward and about shaft 29 in a similar manner to flanges 26 and 27.

Interpositioned between these flanges 26 and 38 is a relatively stiff spring washer 40 by way of which force from the driving cam 36 is communicated to the piston through the driving block 21 and driving pawl 19. A return spring 41 positioned between blocks 21 and 22, while serving to maintain a tight assembly along shaft 31 by keeping the driving and driven cam faces together further serves to return the driving block and pawl 19 thereon to their retracted or initial position upon the completion of each driving stroke of the driving cam 36.

The cam driving gear 35 is shown as driven by way of gear 45 mounted for free rotation about shaft 46. Shaft 47 extending rearward from the speed reducing gear cluster within the forward housing 48 includes a gear surface 50 that operates when driven by gear 51 to drive gear 52. The motor shaft gear 55 when driven by the motor of the gun operates by way of the gear cluster within the forward housing, to drive the shaft driving gear 51. The speed reducing arrangement within the forward housing 48 may be of any suitable design even to including a planetary gear assembly as positioned between the motor gear 55 and shaft driving gear 51.

In operating the gun thus far described, the piston handle 16 is lifted to an up or sideways position as required to place a smooth surface of the piston against the pawls 19 and 20. The piston is now free to be manually drawn rearward through the gun sufficiently as to insert a caulk containing cartridge, such as 8, into the receptacle portion 7 of the gun as shown. The now free piston is then forwardly directed against the base of the cartridge and the handle 16 rotated to a downwardly position. This positions the notched surface of the piston in operative engagement with the driving and holding pawls 19 and 20 respectively. Thereafter, by operation of the motor as by compressing trigger 9, the driving cam 36 is caused to rotate in a direction to effect forward movement of the driven cam member 37 and by way of the bow spring 40 effect forward movement of the driving block 21 and driving pawl 19 thereon. By reason of the driving pawl's engagement with the notched surface of the piston, the piston is forcefully driven forward through the gun to drive caulking from the cartridge by way of the discharge nozzle 11. Forward movement of the piston through the receptacle and cartridge therein operates to force caulking from the cartridge at a rate proportional to the rate the piston is caused to move through the gun. The forward travel of the piston with each cam stroke is determined by the length and pitch angle of the driving cam face as applied to the reciprocating member upon which preferably is provided a similarly configurated cam surface.

While herein is shown in FIG. 4 the driving cam member 36 as including four cam faces, it is understood that one face as in FIG. 8 or two or three such cam faces will likewise suffice. A single driving stroke of the cam may advance the piston from 1/16 inch to 3/16 inch depending upon the structure of the driving cam. The spacing of the notches along the piston's surface will further regulate its movement through the gun. The advanced piston is instantly held in its advanced position by action of the holding pawl 20.

In the variation of the device as shown in FIG. 8 it will be noted that the drop-off point 57 of the cam surface is at a slight angle. This structure provides for a rapid but not instantaneous reset of the cam surface as is the case in FIG. 4 and thereby is eliminated the noise or click instantaneous reset of the cam will produce as the driving and driven cam faces snap together upon completion of a cam driving cycle.

Should forward movement of the piston be forcefully stopped, or should the reacting pressure against the forward end of the piston exceed a predetermined value as by a slowing of caulking flow from the gun at a rate less than represented by piston movement, the force of the driving cam stroke will simply be absorbed by a flattening of the bow spring washer 40 to a degree required to regulate and limit the force applied to the caulk driving end of the piston by reciprocal movement of the driving cam surface.

While in FIG. 4 is shown the force absorbing member as a bow spring washer 40, a stiff resilient mass such as a rubber washer 58, as shown in FIG. 8, will likewise suffice. Such a resilient mass as 58 may be bonded to the surfaces of plates 26 and 38 if so desired. In each instance there is provided means for absorbing the power stroke of the driving member should the reacting force against the piston prevent its normal regulated forward movement during operation of the gun's motor.

Because of the speed reduction required of the drive linkage between the motor and piston, a relatively small and light constructed motor will suffice to drive the piston through the gun with a force of approximately 400 psig at the cam face. Therefore, because of this developed force at the low speed end of the drive, there may be further provided within the drive linkage between the motor and piston and in lieu of or in addition to the washer 40, a slipping clutch mechanism as shown in FIG. 7 that operates to disengage drivably the motor from the piston should overloading or stopping of the piston occur during operation of the motor. Such stopping of the piston could be caused by the piston reaching its most forwardly position within the cartridge or by the operator attempting to force old and set-up caulking from the gun. Such forceful stopping of the piston during motor operation could result in an instantaneous binding up or damage to the drive mechanism of the gun or rupture of the gun case. What must be further considered, with such power operated guns, is the natural flow rate of the caulking being dispensed. Caulking of widely differing viscosities will flow at widely differing rates from the same size discharge orifice in the nozzle under the same pressure conditions.

Any attempt to forcefully accelerate this normal flow rate will result in a rapid pressure buildup in the cartridge and rupture of the cartridge case. Here the clutch mechanism within the gun, whether representing the bent spring washer 40 or slip clutch assembly 59 of FIG. 7 or both, is set to yield or slip should the maximum force against the caulk driving end of the piston exceed a predetermined selected value as below the rupture point of the cartridge case. Here the slipping or yielding point of the clutch is set to interrupt movement between the motor and driving pawl if the piston pressure exceeds say 125 psig. This operating pressure of the gun exceeds by at least three times the force generally applied to caulking dispensed from hand operated guns and yet well within the rupture point of the cartridge case.

The clutch assembly as shown in FIG. 7 includes a free driven gear 60 and a driving gear 61. The free driven gear 60 is clamped as by a spider spring 62 in frictional engagement with an extending flange 63 forming an integral part of the driving gear 61. A sleeve 64 pressed into position within the driving gear, includes a flange 65 that operates to compress spring 62 as required to maintain the driven and driving gears in driving relation one with the other. The clutch assembly as shown may be substituted in the gear cluster for gear 66.

In the mechanism shown in FIG. 4, all piston driving parts shall be formed from hardened steel, otherwise where practical, all parts throughout the gun shall be of the lightest material practical in order to produce a light rugged gun structure.

It is to be understood that throughout the device where needed, all bearing surfaces shall be of the oil impragnated type or better and suitable thrust bearings surfaces shall be provided where necessary throughout the gun in accordance with good manufacturing practice.

While herein is shown two forms of clutch mechanisms that have been found suitable for mounting within the piston driving linkage, it is understood that other forms of clutch mechanisms will suffice.

While the reciprocating member is shown as including a cam face for receiving movement from the drive member 38 it is understood that motion may be applied to the reciprocating member 31 in any manner found suitable and from this member to the piston driving pawl 19. The arrangement and disposition of the various parts within the gun may be selectively varied. The structure may be so arranged that the bow spring washer 40 may be positioned behind the gear 35 if so desired.

What I therefore claim and desire to cover by letters Patent is:

1. A hand held electric caulking gun including in combination, a receptacle for receiving therein a caulk containing cartridge having a caulk dispensing nozzle thereon, a piston movable when driven through said cartridge to force the caulking therein from said nozzle, a reciprocating surface, an electric motor, a speed reducing drive train connecting said motor with said reciprocating surface and operative when driven by said motor to cause reciprocal movement of said surface, a notched surface extending along a surface of said piston, a driving pawl yieldably engaging the notched surface of said piston and movable by reciprocal movement of said reciprocating surface to engage in driving relation the notched surface of said piston to drive said piston forwardly through said receptacle to force the caulking therein from said nozzle, a holding pawl maintained in yielding engagement with the notched surface upon said piston and operative to hold said piston in its forwardly driven position and resilient means operatively associated with said driving pawl to allow for stoppage of movement of said driving pawl should the reacting force against the caulk driving end of the piston exceed a predetermined value during operation of said motor.

2. A caulking gun as called for in claim 1 wherein said reciprocating surface is in the form of a rotating cam.

3. A caulking gun as called for in claim 1 wherein said resilient means is in the form of a compressible spring.

4. A caulking gun as called for in claim 1 wherein said resilient means is in the form of a rubber mass.

5. A caulking gun as called for in claim 1 wherein said resilient means is in the form of a bow-spring washer.

6. A caulking gun as called for in claim 2 further including means for disengaging the driving and holding pawls from the piston to allow manual withdrawal of the piston through the gun.

7. A caulking gun as called for in claim 3 further including means for disengaging the driving and holding pawls from the piston to allow manual withdrawal of the piston through the gun.

8. A caulking gun as called for in claim 4 further including means for disengaging the driving and holding pawls from the piston to allow manual withdrawal of the piston through the gun.

9. A caulking gun as called for in claim 5 further including means for disengaging the driving and holding pawls from the piston to allow manual withdrawal of the piston through the gun.

10. A hand held electric caulking gun including in combination, a receptacle for receiving therein a caulk containing cartridge having a caulk dispensing nozzle thereon, a piston movable when driven through said cartridge to force the caulking therein from said nozzle, means including a reciprocating cam surface, an electric motor, a speed reducing drive train connecting said motor with said cam surface and operative when driven by said motor to cause reciprocal movement of said cam surface, a notched surface extending along a surface of said piston, a driving pawl yieldably engaging the notched surface upon said piston and operatively responsive to reciprocating movement of said cam surface to drive said piston forwardly through said receptacle to force the caulking therein from said nozzle, a holding pawl yieldably engaging the notched surface of said piston and operative to hold said piston in its forwardly driven position and clutch means interposed between said motor and piston and operative to disengage said piston from the motor should the force against the caulk driving end of the piston exceed a predetermined value during operation of said motor.

11. A hand held electric caulking gun as called for in claim 10 wherein said clutch is slippable to selectively regulate the pressure that is applied to the caulking within the cartridge during operation of the motor.

12. A caulking gun as called for in claim 10 including means for disengaging the piston from both its driving and holding pawls to allow manual retraction of the piston through the gun.

13. A hand held electric caulking gun including in combination a receptacle for receiving therein a caulk containing cartridge having a caulk dispensing nozzle thereon, a piston movable when driven through said cartridge to force the caulking therein from said nozzle, driving means for said piston including a reciprocating cam surface, an electric motor, a speed reducing drive train drivably connecting said motor with said cam surface and operable when driven by said motor to cause reciprocal movement of said cam surface, a piston driving pawl disposed to be forwardly driven by reciprocal movement of said cam surface, a series of teeth formed along a surface of said piston and drivably engaged by said driving pawl in a manner to cause forward movement of said piston through said cartridge responsive to reciprocating movement of said cam surface, piston holding means movable to hold said piston in its forwardly driven position and resilient means interposed between said piston and motor and operative to absorb the reciprocal movement of said cam surface so that the driving pawl will not reciprocate upon a predetermined movement restraining force being applied to said piston during operation of said motor.

14. A caulking gun as called for in claim 13 wherein said resilient means is in the form of a compressable spring.

15. A caulking gun as called for in claim 13 wherein said resilient means is in the form of a bow-spring washer.

16. A caulking gun as called for in claim 13 wherein said resilient means is in the form of rubber mass.

17. A caulking gun as called for in claim 13 further including means for releasing said piston from both its driving pawl and holding means to allow rearward manual movement of the piston through the gun.

18. A hand held electric caulking gun including in combination, a receptacle for receiving therein a caulk containing cartridge having a caulk dispensing nozzle thereon, a piston movable when driven through said cartridge to force the caulking therein from said nozzle, a reciprocating surface, an electric motor, a speed reducing drive train connecting said motor with said reciprocating surface and operative when driven by said motor to cause reciprocal movement of said surface, a notched surface extending along a surface of said piston, a driving pawl yieldably engaging the notched surface of said piston and movable, by reciprocal movement of said reciprocating surface, to engage in driving relation the notched surface of said piston to drive said piston forwardly through said receptacle to force the caulking therein from said discharge nozzle, a holding pawl maintained in yielding engagement with the notched surface upon said piston and operative to hold said piston in its forwardly driven position and resilient means disposed between said reciprocating surface and said driving pawl and yieldable to absorb the reciprocal movement of said reciprocating surface as required to arrest movement of said driving pawl should the reacting force against the caulk driving end of the piston exceed a predetermined value during operation of said motor.

* * * * *